US005905046A

United States Patent [19]

Takeda et al.

[11] Patent Number: 5,905,046

[45] Date of Patent: May 18, 1999

[54] BIODEGRADABLE AND HYDROLYZABLE SHEET

[75] Inventors: Yasushi Takeda; Toshiya Okubo; Chieko Arita, all of Kakegawa; Chizu Otani, Shizuoka; Yoshishige Yoshioka, Okazaki; Fumio Matsuoka, Uji; Naoji Ichise, Ushi, all of Japan

[73] Assignees: Uni-Charm Corporation; Unitika Ltd., both of Japan

[21] Appl. No.: 08/817,723

[22] PCT Filed: Oct. 11, 1996

[86] PCT No.: PCT/JP96/02974

§ 371 Date: Apr. 23, 1997

§ 102(e) Date: Apr. 23, 1997

[87] PCT Pub. No.: WO97/13920

PCT Pub. Date: Apr. 17, 1997

[30] Foreign Application Priority Data

Oct. 13, 1995 [JP] Japan ..... 7-264566

[51] Int. Cl.[6] ..... D04H 1/00

[52] U.S. Cl. ..... 442/416; 428/913; 442/415; 442/59

[58] Field of Search ..... 442/59, 416, 415; 428/913

[56] References Cited

U.S. PATENT DOCUMENTS

| | | | |
|---|---|---|---|
| 4,372,447 | 2/1983 | Miller | 206/812 |
| 4,755,421 | 7/1988 | Manning et al. | 428/224 |
| 5,292,581 | 3/1994 | Viazmensky et al. | 428/288 |
| 5,384,189 | 1/1995 | Kuroda et al. | 428/288 |
| 5,434,004 | 7/1995 | Ajioka et al. | 428/411.1 |
| 5,679,421 | 10/1997 | Brinton, Jr. | 428/34.3 |
| 5,714,230 | 2/1998 | Kameoka et al. | 428/141 |

FOREIGN PATENT DOCUMENTS

| | | |
|---|---|---|
| A2-0 654 492 | 11/1994 | European Pat. Off. . |
| A-2-74694 | 3/1990 | Japan . |
| A-6-500603 | 1/1994 | Japan . |
| A-7-3600 | 1/1995 | Japan . |
| A-7-70896 | 3/1995 | Japan . |
| A-7-133569 | 5/1995 | Japan . |
| A-7-189098 | 7/1995 | Japan . |

OTHER PUBLICATIONS

International Search Report dated Dec. 25, 1996 and mailed Jan. 14, 1997.
Abstract for JP 7–70896.
Abstract for JP 2–74694.
Abstract for JP 7–3600.
Abstract for JP 7–189098.
Abstract for JP 7–133569.
Abstract for JP 7–500603 (International Publication No. WO 92/05311).

*Primary Examiner*—James J. Bell
*Attorney, Agent, or Firm*—Young & Basile, P.C.

[57] ABSTRACT

A water-disintegrable sheet having biodegradability. The sheet comprises one or more kinds of biodegradable synthetic fibers, and one or more kinds of natural fibers and/or regenerated fibers, all the fibers being bound together by a binder such that the binding power of the binder will be substantially lost in water. The sheet has a given degree of tensile strength and good softness, coupled with a required degree of liquid absorbency, and still has some biodegradation property. Therefore, the sheet can be flushed in a flush toilet without involving any appreciable increase in the volume of solid residues in a septic tank and/or in a sewage disposal plant and is therefore suitable for use in the form of a wet wiper in particular.

6 Claims, No Drawings

BIODEGRADABLE AND HYDROLYZABLE SHEET

FIELD OF THE INVENTION

The present invention relates to a water-disintegrable sheet having biodegradability for use in applications including wet wipers for cleaning domestic articles such as wet wipers for cleaning toilets, and wet wipers for cleansing human bodies as represented by those for anal cleansing, the water-disintegrable sheet being such that it is disposable as waste in a flush toilet or the like and yet has good hand (softness).

BACKGROUND OF THE INVENTION

Hitherto, various techniques have been proposed for provision of a disposable sheet material capable of being washed away in a flush toilet, more specifically a water-disintegrable paper of the type which includes a soft-wood pulp mass and a water-soluble binder (CMC, PVA or the like) with which the constituent parts of the wood pulp mass are bound together (as described in Japanese Patent Application Laid-Open Publication Nos. 2-154095, 2-229295, and 3-167400). Also, a number of disclosures have been made with respect to wipes using such a sheet material, as described in Japanese Patent Application Laid-Open Nos. 2-149237, 3-182218, and 3-292924.

With such water-disintegrable paper and wipes using such a paper material it is expected that they, after having been flushed away with water in a flush toilet, can be biologically treated to a satisfactory extent in a septic tank and/or in a sewage disposal plant, because their main component material is a soft-wood pulp. However, a sheet comprised chiefly of a soft-wood pulp is a material known commonly as paper and is not softer than a nonwoven fabric formed from a synthetic fiber material. Therefore, the sheet feels less comfortable to the hand or skin. Although the sheet possesses good hydrophilic and water absorption properties, it has disadvantages that in its wet condition the sheet tends to collapse as its fiber components lose their impact resilience, being thus liable to feel sticky to the skin, and that in such a condition the sheet tends to be adversely affected in respect of softness, an essential feature required of wipes.

Whilst, it is widely known to use a wet-laid nonwoven fabric containing a synthetic fiber material (such as PE (polyethylene), PP(polypropylene), or PET (polyethyleneterepythalate)) to provide non-water-disposable wipes. When used in applications such as wipes and sanitary materials, a nonwoven fabric comprising such a synthetic fiber feels softer than paper and exhibits more comfortable hand. However, the trouble with such a material is that the material is non-biodegradable in a septic tank and/or in a sewage disposal plant. This fact leads to an important problem such as a noticeable increase in the volume of solid residues.

As such, recently, a water-disposable sheet including a biodegradable fiber material has been proposed as described in Japanese Patent Application Laid-Open No. 7-70896. However, the teaching of the JP Laid-Open No. 7-70896 is such that the sheet is comprised merely of a biodegradable synthetic fiber and a binder and, therefore, does not meet the need for a sheet capable of sufficient absorption of an impregnating solution thereinto as required for fabrication of a wet wiper. In addition, the sheet has much poorer tensile strength as compared with conventional sheets of the type comprised of a pulp component and a binder, which means that a product using the sheet is of insufficient strength.

DISCLOSURE OF THE INVENTION

The present invention is directed toward solving aforesaid problems with the prior art and, therefore, it is a primary object of the invention to provide a water-disintegrable sheet having biodegradability which possesses a given degree of tensile strength and good softness, coupled with a required degree of liquid absorbency, and still has some biodegradation property such that the sheet can be flushed in a flush toilet without involving any appreciable increase in the volume of solid residues in a septic tank and/or in a sewage disposal plant and is therefore suitable for use in the form of a wet wiper in particular.

In accordance with the present invention, a water-disintegrable sheet having biodegradability is provided which comprises one or more kinds of biodegradable synthetic fibers, and one or more kinds of natural fibers and/or regenerated fibers, all the fibers being bound together by a binder such that the binding power of the binder will be substantially lost in water.

According to the invention, a biodegradable synthetic fiber of hydrophobic nature is blended with a natural fiber and/or a regenerated fiber in optimum proportions, whereby the sheet, without losing the required liquid absorbency, can retain some bulkiness and good softness in its liquid absorbed condition so that the sheet can exhibit excellent performance quality by which it is rendered particularly suitable for use in such an application as wet wiper. Further, according to the invention, the biodegradable synthetic fiber and the natural fiber and/or regenerated fiber are bound together by a binder whose binding power will be substantially lost in water. Therefore, when the sheet in the form of a wet wiper is discarded into water in a flush toilet after use, the biodegradable fiber and the natural fiber and/or regenerated fiber are instantly loosely separated and are subsequently biodegraded in a septic tank or in a sewage disposal plant. Therefore, the disposal of the sheet will not give rise to any appreciable increase in the quantity of solid residues.

In the present invention, each biodegradable synthetic fiber is comprised of a thermoplastic polymer and, for such a polymer, a hydrophobic aliphatic polyester polymer is advantageously used. Examples of aliphatic polyester polymers include poly($\alpha$-hydroxy acid), such as polyglycol acid or polylactic acid, and copolymer of constituent repeating units of such polymer. Also enumerated as examples of such polyester polymers are (i) poly($\omega$-hydroxyalkanoate), such as poly($\epsilon$-caprolactone) or poly($\beta$-propiolactone); (ii) poly ($\beta$-hydroxyalkanoate), such as poly-3-hydroxypropionate, poly-3-hydroxybutylate, poly-3-hydroxycaprolate, poly-3-hydroxyheptanoate, or poly-3-hydroxyoctanoate; and (iii) copolymer of constituent repeating units of such polymer and constituent repeating units of poly-3-hydroxyvalerate or poly-4-hydroxybutylate. Polycondensates of glycol and dicarboxylic acid are also useful for the present purpose, including for example polyethylene oxalate, polyethylene succinate, polyethylene adipate, polyethylene azelate, polybutylene oxalate, polybutylene succinate, polybutylene adipate, polybutylene sebacate, polyhexamethylene sebacate, polyneopentyl oxalate, or copolymer of constituent repeating units of any of these polymers.

In the present invention, especially preferred polymer of the above enumerated polymers are (1) polyethylene succinate; (2) a copolymer polyester in which ethylene succinate is copolymerized with butylene succinate, butylene adipate, or butylene sebacate, and in which the molar percentage of the ethylene succinate in the total copolymer is 65 mole % or more; (3) a polylactic acid-based polymer having a melting point of 100° C. or more; (4) polybutylene succinate; and (5) a copolymer polyester in which butylene succinate is copolymerized with ethylene succinate, butylene adipate, or butylene sebacate, and in which the molar percentage of the butylene succinate in the total copolymer is 65 mole % or more, because these polymers have high heat resistance, high spinnability, and good biodegradability.

With particular reference to the copolymer of ethylene succinate and the copolymer of butylene succinate of the foregoing polymers, it is noted that if the molar percentage of the ethylene succinate or of the butylene succinate, whichever the case may be, in the total copolymer is less than 65 mole %, the copolymer has a low melting point and filaments spun from the copolymer have poor spinnability, even though the copolymer has good biodegradability.

The polylactic acid-based polymer is preferably such that the polymer is one selected from the group consisting of poly(D-lactic acid), poly(L-lactic acid), a copolymer of D-lactic acid and L-lactic acid, a copolymer of D-lactic acid and hydroxycarboxylic acid, and a copolymer of L-lactic acid and hydroxycarboxylic acid, the polymer having a melting point of 100° C. or more, or a blend of these polymers. In the case where polylactic acid-based polymer is a copolymer of lactic acid and hydroxycarboxylic acid, examples of such polymer are glycolic acid, hydroxybutyric acid, hydroxyvaleric acid, hydroxypentanoic acid, hydroxycaroic acid, hydroxyheptoic acid, and hydroxyoctoic acid.

A blend of plural kinds of polymers selected from those individually having biodegradability may also be employed.

The thermoplastic polymer which constitutes the biodegradable synthetic fiber has good spinnability and enables production of filaments to have good characteristic features, if it has a number-average molecular weight of about 20,000 or more, preferably 40,000 or more, more preferably 60,000 or more. In order that the polymer may have a greater degree of polymerization, the polymer may be one such that it has been chain-extended with a small amount of diisocyanate, tetracarboxylic acid dianhydride, or the like.

The natural fiber and regenerated fiber should have good liquid absorbency and good impregnant retention capability, basically from the standpoints of such features, preferred examples of the natural fiber are pulp, cotton, ramie, hemp, flax and the like. For the regenerated fiber, viscose rayon, cuprammonium rayon, solvent spun rayon, and cellulose acetate, especially a cellulose acetate having a degree of substitution of not more than 2.0, are preferred. While these fibers may be advantageously used, from the standpoint of cost consideration for a disposable product, the use of pulp is preferred. A blend of plural kinds of natural fibers and/or regenerated fibers may also be used.

The weight ratio of the biodegradable synthetic fiber to the natural fiber and/or regenerated fiber is preferably within the range of (biodegradable synthetic fiber)/(natural fiber and/or regenerated fiber)=20/80–75/25. If the proportion of the biodegradable synthetic fiber is lower than this range, the resulting sheet is likely to have less favorable hand in respect of softness and bulkiness. If the proportion of the biodegradable fiber is excessively larger than the foregoing range, the proportion of the natural fiber and/or regenerated fiber is reduced so much with the result that while the sheet has greater flexibility and softer and more bulky hand on one hand, it may have lower tensile strength on the other hand, the sheet being thus unlikely to meet necessary absorbency for wipes.

Examples of binders useful for binding aforesaid fibers together include starch or its derivatives, sodium alginate, tragacanth gum, guar gum, xanthan gum, arabic gum, carrageenan, galactomannan, gelatin, casein, albumin, pullulan, polyethylene oxide, polyvinyl alcohol, viscose, polyvinyl ethyl ether, sodium polyacrylate, sodium polymethacrylate, polyacrylamide, hydroxylated derivative of polyacrylic acid, polyvinylpyrrolidone/vinylpyrrolidone vinyl acetate copolymer, carboxyethyl cellulose or salt thereof, and carboxymethyl cellulose or salt thereof.

These binders need not necessarily be water soluble as long as they are such that the adhesivity of the binder will be substantially lost when the sheet is flushed in water. Binders having water-swell characteristics or aquadegradability may also be used for the purpose of the invention.

In order to supplement the strength of the sheet, it is possible to heat the sheet itself to cause the biodegradable synthetic fiber to be melted so that individual fiber components are thermally fusion bonded together. It is noted, however, that such thermal fusion bonding should be limited to the extent that the dispersibility of the sheet in flush water is not seriously impaired.

Of the above enumerated binders, carboxymethyl cellulose and alkaline metal salt thereof, and sodium salt of carboxymethyl cellulose are preferred when the following three aspects are considered, namely, sheet separation and dispersion to be effected instantly upon the sheet being flushed in water; microbial treatment or biodegradation of the sheet fragments in a sewage disposal plant; and economical cost. Further, after individual fibers have been bound together with such alkaline metal salt or sodium salt, that is, during and after the stage of sheet fabrication, a polyvalent metal-containing solution may be added to thereby produce a polyvalent metal salt of carboxymethyl cellulose so as to provide for improvement in sheet strength.

The required amount of binder may vary according to the type of binder, kinds of fibers to be used, and mixing proportions of the fibers, but is usually preferably 1% or more but not more than 30% of the total weight of the sheet. If the proportion of the binder is less than 1%, the binder cannot fully exhibit its binding function. If the proportion is more than 30%, the sheet, as made into a wet wiper, feels hard and may not satisfactorily function as a wiper, and in addition the sheet is no longer attractive in economical aspect.

For the fabrication of sheets in accordance with the present invention, it is preferable to employ a conventional wet-lay method of manufacturing paper by using a so-called paper machine such as Fourdrinier paper machine or cylinder paper machine. For example, according to the wet-lay method, biodegradable cut fibers and pulp material are uniformly dispersed in a water medium containing a suitable amount of binder, and the so dispersed stock is passed sequentially through the stages of paper making, dehydration, and drying, being thus finally made into a sheet form.

However, it is not intended that the fabrication of sheets be made according to the foregoing method, but other method may be suitably employed such that a web produced by a dry method, such as carding process or air laid process, is subjected to spraying of an aqueous binder solution.

For fabrication of a wet wiper using the sheet of the present invention, the sheet is impregnated with a cleaning fluid containing organic solvents, such as surfactant and alcohol, disinfectant, antibacterial agent, bacteriostat, pH adjustor, abrasive, colorant, viscosity bodying agent, moisturizer, perfume, and/or deodorizer. Instead of using a cleaning fluid containing the foregoing ingredients, it is possible to add particular components directly into the sheet when the sheet is being fabricated or after the sheet is fabricated.

In this way, the water separable sheet having biodegradability of the invention possesses good softness and high liquid absorbency, which are both basic properties required for wet wipers, and has advantages that the sheet is separated and dispersed in water promptly upon the sheet, after use, being flushed in water in a flush toilet or the like, and that since the sheet is finally subjected to biodegradation by microorganisms and the like in a septic tank and/or in wastewater treatment facilities, the sheet involves no possibility of producing any large quantity of sludge (solid content). Therefore, the sheet of the invention is suitable for use in such applications as products which can be flushed in a flush toilet, or more specifically sanitary articles including disposable diapers, sanitary pads and liners, and wet wipers such as for anal cleansing for babies and old persons and for cleaning toilets' seats.

DESCRIPTION OF THE EMBODIMENTS

Next, the invention will be described in further detail on the basis of the following examples. It is understood, however, that the present invention is in no way limited to these examples. In the following examples, various characteristic values were determined according to the following evaluation methods.

Water disintearability (disintegrability when flushed in water)

Into a 300-milliliter glass beaker was poured 300 milliliter of deionized water, and the beaker was stirred at 600 rpm by means of a magnetic stirrer ("CONSTANT TORQUE MAGMIX STIRRER" made by Mitamura Riken Kogyo Inc.). A disc type rotor (35 mm dia., 12 mm thick; "STAR HEAD" magnetic stir bar) was used in this connection. A specimen cut to 10 cm by 10 cm was placed into the so stirred water, and observation was made to check how fast the specimen was loosened, on the following criteria.

Good separability in water O: where the specimen was reduced to small pieces within 100 sec.

Poor separability in water X: where a time period of 100 sec. or more was required until the specimen was reduced to small pieces.

Compressive resilience (g)

A specimen having a width (warpwise) of 50 mm and a length (weftwise) of 100 mm was rolled weftwise into a cylindrical shape, and the so rolled specimen was compressed warpwise by using a tensile strength tester ("Tensilon" UTM-4-1-100", made by Toyo Baldwin) at a compression rate of 50 mm/min. A maximum compressive strength value measured was taken as compressive resilience (g). The higher the value is, the harder the sheet feels.

Water absorbency (mm)

A specimen was cut to 120×15 mm, and a marked line was drawn at a distance of 5 mm from a shorter side of the specimen. A portion of the specimen which extends from the shorter side to the marked line was put into distilled water from above and was allowed to stand for one minute. Then, the height of water rise in the specimen was measured, and the measured value was taken as water absorbency (mm). The higher the value, the more is the specimen liable to absorb water.

Biodegradability

The aerobic biodegradability of each specimen was measured in accordance with JIS-K-6950. Upon lapse of 28 days after the start of the biodegradability test, the degree of biodegradation (%) was measured with respect to the specimen, the measurement being taken as biodegradability. The sludge used in the test was a domestic wastewater sludge from a septic tank at a prefectural housing complex, Shimeno, Osaka, Japan.

Tensile strenath (a/25 mm width)

Measurement was made in accordance with a method specified in JIS-L-1096A. Ten specimen, each of 150 mm in length and 25 mm in width, were prepared, and by using a constant stretch type tensile strength tester (model UTM-4-1-100, made by Toyo Baldwin), each specimen was stretched by being clamped at positions 100 mm spaced apart from each other, at a stretch rate of 10 cm/min in both directions of the specimen. The average of maximum breaking load values (g/25 mm width) obtained was taken as the basis for evaluation.

EXAMPLE 1

Short cut fibers having a fiber fineness of 2 denier and a fiber length of 5 mm were produced using polybutylene succinate resin. Specifically, the polybutylene succinate resin was melt spun into filaments through a circular spinneret at a spinning temperature of 180° C. and at a mass outflow rate of 0.55 g/min from each orifice. The filaments were quenched and then treated with a finishing lubricant, and were taken up as an undrafted filament tow on a draft roll at a take-up rate of 1,000 m/min. The undrafted filament tow was drafted by a known drafting machine at a draft ratio of 2.6 to a filament fineness of 2 denier. This 2-denier filament was cut into fibers having a fiber length of 5 mm.

Subsequently, mixing of soft wood (coniferous) pulp/aforesaid polybutylene succinate fiber of 5 mm in fiber length/sodium salt of carboxymethyl cellulose (made by Nichirin Chemical Industries Ltd.; DS=0.40, pH=6.5) was made in a dry weight ratio of 24/70/6, and a sheet was produced from the mixture by employing a rectangular sheet machine (made by Kumagai Riki Kogyo Co., Ltd.) and according to a wet process. The wet sheet was dried in a rotary dryer (made by Kumagai Riki Kogyo Co., Ltd.) at a temperature of 85° C. for 100 sec. As a result, a sheet having a weight per unit area of 40 g/m$^2$ was obtained. Characteristics of the sheet is shown in Table 1.

TABLE 1

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Water disintegrability | ○ | ○ | ○ | ○ | ○ | ○ | ○ | ○ | ○ | ○ | ○ |

TABLE 1-continued

| | Example 1 | Example 2 | Example 3 | Example 4 | Example 5 | Example 6 | Example 7 | Example 8 | Example 9 | Example 10 | Example 11 |
|---|---|---|---|---|---|---|---|---|---|---|---|
| Compressive resilience(g) | 37 | 82 | 133 | 24 | 194 | 44 | 161 | 207 | 68 | 74 | 35 |
| Water absorbency(mm) | 37 | 47 | 47 | 18 | 48 | 47 | 46 | 48 | 45 | 46 | 52 |
| Biodegradability (%) | 54 | 54 | 53 | 55 | 52 | 55 | 52 | 52 | 55 | 58 | 68 |
| Tensile strength (g/25 mm width) | 108 | 182 | 270 | 48 | 322 | 151 | 388 | 413 | 167 | 194 | 110 |

EXAMPLE 2

A mixture weight ratio different from that in EXAMPLE 1 was used. More specifically, the mixture ratio of soft wood pulp/polybutylene succinate fiber of 5 mm fiber length/sodium salt of carboxymethyl cellulose was changed to 47/47/6 in dry weight ratio. In other respects, operation was carried out in the same way as in EXAMPLE 1 to obtain a sheet. Characteristics of the sheet thus obtained are shown in Table 1.

EXAMPLE 3

A mixture weight ratio different from that in EXAMPLE 1 was used. More specifically, the mixture ratio of soft wood pulp/polybutylene succinate fiber of 5 mm fiber length/sodium salt of carboxymethyl cellulose was changed to 70/24/6 in dry weight ratio. In other respects, operation was carried out in the same way as in EXAMPLE 1 to obtain a sheet. Characteristics of the sheet thus obtained are shown in Table 1.

EXAMPLE 4

A change from EXAMPLE 1 was made in the mixture weight ratio of pulp to biodegradable synthetic fiber. More specifically, the mixture ratio of soft wood pulp/polybutylene succinate fiber of 5 mm fiber length/sodium salt of carboxymethyl cellulose was changed to 14/80/6 in dry weight ratio. In other respects, operation was carried out in the same way as in EXAMPLE 1 to obtain a sheet. Characteristics of the sheet thus obtained are shown in Table 1.

EXAMPLE 5

A change from EXAMPLE 1 was made in the mixture weight ratio of pulp to biodegradable synthetic fiber. More specifically, the mixture ratio of soft wood pulp/polybutylene succinate fiber of 5 mm fiber length/sodium salt of carboxymethyl cellulose was changed to 80/14/6 in dry weight ratio. In other respects, operation was carried out in the same way as in EXAMPLE 1 to obtain a sheet. Characteristics of the sheet thus obtained are shown in Table 1.

EXAMPLE 6

In this EXAMPLE, the proportion of the binder in the total mixture weight was changed so that the proportion was smaller than that in EXAMPLE 2. More specifically, the mixture ratio of soft wood pulp/polybutylene succinate fiber of 5 mm fiber length/sodium salt of carboxymethyl cellulose was changed to 49/49/2 in dry weight ratio. In other respects, operation was carried out in the same way as in EXAMPLE 2 to obtain a sheet. Characteristics of the sheet thus obtained are shown in Table 1.

EXAMPLE 7

In this EXAMPLE, the proportion of the binder in the total mixture weight was changed so that the proportion was larger than that in EXAMPLE 2. More specifically, the mixture ratio of soft wood pulp/polybutylene succinate fiber of 5 mm fiber length/sodium salt of carboxymethyl cellulose was changed to 35/35/30 in dry weight ratio. In other respects, operation was carried out in the same way as in EXAMPLE 2 to obtain a sheet. Characteristics of the sheet thus obtained are shown in Table 1.

EXAMPLE 8

In this EXAMPLE, the proportion of the binder in the total mixture weight was changed from that in EXAMPLE 2. More specifically, the mixture ratio of soft wood pulp/polybutylene succinate fiber of 5 mm fiber length/sodium salt of carboxymethyl cellulose was changed to 32.5/32.5/35 in dry weight ratio. In other respects, operation was carried out in the same way as in EXAMPLE 1 to obtain a sheet. Characteristics of the sheet thus obtained are shown in Table 1.

EXAMPLE 9

The biodegradable synthetic fiber used in EXAMPLE 1 was changed to a copolymer. Specifically, short cut fibers having a fiber fineness of 2 denier and a fiber length of 5 mm were produced using a copolymer resin of butylene succinate/butylene adipate (copolymer molar ratio: 80/20). More particularly, the butylene succinate/butylene adipate copolymer resin was melt spun into filaments through a circular spinneret at a spinning temperature of 160° C. and at a mass outflow rate of 0.51 g/min from each orifice. The filaments were quenched and then treated with a finish lubricant, and were taken up as an undrafted filament tow on a draft roll at a take-up rate of 1000 m/min. Then, the undrafted filament tow was drafted by a known drafting machine at a draft ratio of 2.4 to a filament fineness of 2 denier. This 2-denier filament was cut into fibers having a fiber length of 5 mm.

Subsequently, mixing of soft wood pulp/aforesaid butylene succinate/butylene adipate copolymer fiber of 5 mm in fiber length/sodium salt of carboxymethyl cellulose (made by Nichirin Chemical Industries Ltd.; DS =0.40, pH=6.5) was made in a dry weight ratio of 47/47/6, and a sheet was produced from the mixture by employing a rectangular sheet machine (made by Kumagai Riki Kogyo Co., Ltd.) and according to a wet process. The wet sheet was dried in a rotary dryer (made by Kumagai Riki Kogyo Co., Ltd.) at a temperature of 85° C. for 100 sec. As a result, a sheet having a weight per unit area of 40 g/m$^2$ was obtained. Characteristics of the sheet is shown in Table 1.

EXAMPLE 10

The type and molar ratio of biodegradable copolymer synthetic fiber were changed from those in EXAMPLE 9.

Specifically, short cut fibers having a fiber fineness of 2 denier and a fiber length of 5 mm were produced using a copolymer resin of L-lactic acid/hydroxycaproic acid (copolymer molar ratio: 70/30). More particularly, the L-lactic acid/hydroxycaproic acid copolymer resin was melt spun into filaments through a circular spinneret at a spinning temperature of 200° C. and at a mass outflow rate of 0.57 g/min from each orifice. The filaments were quenched and then treated with a finishing lubricant, and were taken up as an undrafted filament tow on a draft roll at a take-up rate of 1,000 m/min. Then, the undrafted filament tow was drafted by a known drafting machine at a draft ratio of 2.7 to a filament fineness of 2 denier. This 2-denier filament was cut into fibers having a fiber length of 5 mm.

Subsequently, mixing of soft wood pulp/aforesaid L-lactic acid/hydroxycaproic acid copolymer fiber of 5 mm in fiber length/sodium salt of carboxymethyl cellulose (made by Nichirin Chemical Industries Ltd.; DS =0.40, pH=6.5) was made in a dry weight ratio of 47/47/6, and a sheet was produced from the mixture by employing a rectangular sheet machine (made by Kumagai Riki Kogyo Co., Ltd.) and according to a wet process. The wet sheet was dried in a rotary dryer (made by Kumagai Riki Kogyo Co., Ltd.) at a temperature of 85° C. for 100 sec. As a result, a sheet having a weight per unit area of 40 g/M$^2$ was obtained. Characteristics of the sheet is shown in Table 1.

EXAMPLE 11

In contrast to EXAMPLES 1 through 10 wherein sheets were made according to the wet process, a sheet was produced by employing the air laid technique.

First, short cut fibers having a fiber fineness of 2 denier and a fiber length of 5 mm were produced using polyethylene succinate resin. Specifically, the polyethylene succinate resin was melt spun into filaments through a circular spinneret at a spinning temperature of 160° C. and at a mass outflow rate of 0.57 g/min from each orifice. The filaments were quenched and then treated with a finishing lubricant, and were taken up as an undrafted filament tow on a draft roll at a take-up rate of 1,000 m/min. The undrafted filament tow was drafted by a known drafting machine at a draft ratio of 2.7 to a filament fineness of 2 denier. This 2-denier filament was cut into fibers having a fiber length of 5 mm.

Subsequently, from the short cut fibers and pulverized soft wood pulp was formed a web according to the air laid method, in a dry wet ratio of polyethylene succinate fiber/soft wood pulp=50/50. The web was then spray-coated with a 10 wt % aqueous solution, previously prepared, of sodium salt of carboxymethyl cellulose (made by Daicel Chemical Industries, Ltd.; "CMC Daicel 1205"). The so coated web was dried in a dryer of the hot air circulation type (made by Tsujii Senki Kogyo Co.) at a temperature of 85° C. for 80 sec. As a result, a sheet comprised of soft wood pulp/polyethylene succinate fiber/sodium salt of carboxymethyl cellulose=47/47/6 and having a weight per unit area of 40 g/m$^2$ was obtained. Characteristics of the sheet is shown in Table 1.

As may be apparent from Table 1, sheets obtained in EXAMPLES 1 to 3, 6, 7, and 9 to 11 were all found satisfactory in water absorbency and biodegradability. Further, these sheets had low compressive resilience and soft hand and, in their wet state, they had adequate softness gentle to the skin and bulky hand, and exhibited good wiping quality when used as a wet wiper. It was obvious, therefore, that they had good advantage over prior art sheets comprised of pulp only. In addition, the sheets had good tensile strength ideal for practical purposes.

The sheet of EXAMPLE 4, as compared with EXAMPLE 1, had a higher biodegradable synthetic fiber content and a lower soft wood pulp content and was therefore less favorable in water absorbency and tensile strength. However, the sheet had good water disintegrability and, in particular, by virtue of its low compressive resilience, the sheet had very soft texture and hand, exhibiting moderate softness gentle to the skin and bulky hand. Therefore, the sheet was found suitable for use in such applications as wet wipers for human body cleansing purposes, typically anal cleansing.

The sheet of EXAMPLE 5, as compared with EXAMPLE 1, had a soft wood pulp content of higher percentage and a biodegradable synthetic fiber content of lower percentage and was therefore less favorable in softness. However, the sheet had high water absorption capability and good water disintegrability and, in particular, the sheet had exceedingly high tensile strength. Therefore, the sheet was found suitable for use in such applications as wet wipers for domestic-articles cleaning purposes as represented by a toilet's seat wiper.

The sheet of EXAMPLE 8, as compared with EXAMPLE 1, had higher contents of soft wood pulp and binder, and was therefore less favorable in softness. However, the sheet had high water absorbency and good water disintegrability and, in particular, the sheet had exceedingly high tensile strength. Therefore, the sheet was found suitable for use in such applications as wet wipers for domestic-articles cleaning purposes as represented by a toilet seat's wiper.

In the aspect of biodegradation performance, the sheets of EXAMPLES 1 through 11 exhibited good aerobic biodegradability in activated sludge, and it was witnessed that test specimens of the sheets, buried in activated sludge, was all biologically degraded 50% or more in 28 days of such burial.

COMPARATIVE EXAMPLE 1

A sheet was produced without the use of biodegradable synthetic fiber. More specifically, mixing of soft wood pulp/sodium salt of carboxymethyl cellulose (made by Nichirin Chemical Industries Ltd.; DS=0.40, pH=6.5) was made in a dry weight ratio of 94/6, and a sheet was fabricated from the mixture according to a wet-lay method and by employing a rectangular sheet machine (made by Kumagai Riki Kogyo Co., Ltd.). The wet sheet was dried in a rotary dryer (made by Kumagai Riki Kogyo Co., Ltd.) at a temperature of 85° C. for 100 sec. As a result, a sheet having a weight per unit area of 40 g/m$^2$ was obtained. Characteristics of the sheet are shown in Table 2.

TABLE 2

| | Comparative Example 1 | Comparative Example 2 | Comparative Example 3 |
|---|---|---|---|
| Water disintegrability | ○ | ○ | ○ |
| Compressive resilience(g) | 255 | 133 | 9 |
| Water absorbency(mm) | 50 | 45 | 3 |
| Biodegradability (%) | 52 | 27 | 55 |
| Tensile strength (g/25 mm width) | 465 | 239 | 21 |

COMPARATIVE EXAMPLE 2

A sheet was formed using a synthetic fiber having no biodegradability. More specifically, mixing of soft wood pulp/polyester fiber (PET)/sodium salt of carboxymethyl cellulose (made by Nichirin Chemical Industries Ltd.; DS=0.40, pH=6.5) was made in a dry weight ratio of 47/47/6, and a sheet was fabricated from the mixture according to a wet-lay method and by employing a rectangular sheet machine (made by Kumagai Riki Kogyo Co., Ltd.). The wet sheet was dried in a rotary dryer (made by Kumagai Riki Kogyo Co., Ltd.) at a temperature of 85° C. for 100 sec. As a result, a sheet having a weight per unit area of 40 g/m$^2$ was obtained. Characteristics of the sheet are shown in Table 2.

COMPARATIVE EXAMPLE 3

A sheet was produced without the use of pulp as a natural fiber. More specifically, mixing of polybutylene succinate fiber having a fiber length of 5 mm/sodium salt of carboxyinethyl cellulose was made in a dry weight ratio of 94/6. The sheet was obtained in the same way as in EXAMPLE 1 in other respects. Characteristics of the sheet are shown in Table 2.

The sheet of COMPARATIVE EXAMPLE 1 was found satisfactory in respect of water absorbency, water disintegrability and biodegradability. However, since its fiber content was pulp only and did not include synthetic fiber, the sheet had hard feel and, when used as a wet wiper, the sheet lacked comfortable feel to the skin. The sheet of COMPARATIVE EXAMPLE 2 was found satisfactory in respect of water absorbency and water disintegrability, and also in respect of softness. However, since its fiber content was polyethylene terephthalate fiber, or a conventional synthetic fiber, the sheet did not have biodegradation performance. The sheet of COMPARATIVE EXAMPLE 3 had poor water absorbency and low tensile strength, since its fiber content was biodegradable synthetic fiber only and did not include natural fiber and/or regenerated fiber.

What is claimed is:

1. A water-disintegrable sheet having biodegradability, comprising one or more kinds of biodegradable synthetic fibers comprised of aliphatic polyester or aliphatic polyesters, and one or more kinds of natural fibers and/or regenerated fibers, all the fibers being bound together by a binder, the binding power of which is substantially lost in water, the binder comprising one or more member selected from the group consisting of starch or its derivatives, sodium alginate, tragacanth gum, guar gum, xanthan gum, arabic gum, carrageenan, galactomannan, gelatin, casein, albumin, pullulan, polyethylene oxide, viscose, sodium polyacrylate, sodium polymethacrylate, polyacrylamide, hydroxylated derivative of polyacrylic acid, polyvinylpyrrolidone/vinylpyrrolidone vinyl acetate copolymer, carboxethyl cellulose or salt thereof, and carboxymethyl cellulose or salt thereof.

2. A water-disintegrable sheet having biodegradability as defined in claim 1, wherein the aliphatic polyester is one of (a) polyethylene succinate, (b) a copolymer in which ethylene succinate is copolymerized with butylene succinate, butylene adipate, or butylene sebacate, (c) polybutylene succinate, (d) a copolymer in which butylene succinate is copolymerized with butylene adipate or butylene sebacate, and (e) a blend of these polymers.

3. A water-disintegrable sheet having biodegradability as defined in claim 1, wherein the aliphatic polyester is one of poly(D-lactic acid), poly(L-lactic acid), a copolymer of D-lactic acid and L-lactic acid, a copolymer of D-lactic acid and hydroxycarboxylic acid, a copolymer of L-lactic acid and hydroxycarboxylic acid, and a blend of these polymers.

4. A water-disintegrable sheet having biodegradability as defined in claim 1, wherein the binder is comprised of carboxymethyl cellulose or a salt thereof.

5. A water-disintegrable sheet having biodegradability as defined in claim 1, wherein the weight ratio of the biodegradable synthetic fiber to the natural fiber and/or regenerated fiber is in the range of (biodegradable synthetic fiber)/(natural fiber and/or regenerated fiber) 20/80–75/25.

6. A water-disintegrable sheet having biodegradability as defined in claim 1, wherein the weight of the binder is not less than 1% but not more than 30% of the total weight of the sheet.

* * * * *